US008550329B2

(12) United States Patent
Busam et al.

(10) Patent No.: US 8,550,329 B2
(45) **Date of Patent: *Oct. 8, 2013**

(54) POCKET WITH SECURE DIVIDERS

(75) Inventors: Edward P. Busam, Mason, OH (US); Jonathan Wicks, Cincinnati, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/412,078

(22) Filed: Mar. 5, 2012

(65) Prior Publication Data

US 2012/0175407 A1 Jul. 12, 2012

Related U.S. Application Data

(63) Continuation-in-part of application No. 12/105,898, filed on Apr. 18, 2008, now Pat. No. 8,152,050.

(60) Provisional application No. 60/913,118, filed on Apr. 20, 2007.

(51) Int. Cl.
*B65D 27/00* (2006.01)
*B65D 37/00* (2006.01)

(52) U.S. Cl.
USPC ..... 229/67.1; 229/67.2; 229/67.3; 229/67.4; 229/72

(58) Field of Classification Search
USPC ..... 229/67.1–67.4, 72
See application file for complete search history.

(56) References Cited

U.S. PATENT DOCUMENTS

| | | | | |
|---|---|---|---|---|
| 4,932,683 | A | 6/1990 | Perazza | |
| 5,009,361 | A | 4/1991 | Chariton et al. | |
| 5,417,509 | A | 5/1995 | Schwartz | |
| 5,447,334 | A | 9/1995 | Hartsock | |
| 5,598,969 | A | 2/1997 | Ong | |
| 5,720,427 | A | 2/1998 | Kachel et al. | |
| 6,209,778 | B1 | 4/2001 | Henrikson et al. | |
| 6,543,379 | B2 | 4/2003 | Schwartz | |
| 6,547,283 | B1 | 4/2003 | Moor | |
| 6,648,374 | B2 | 11/2003 | Takemura | |
| 6,666,610 | B1 | 12/2003 | Moor et al. | |
| 6,796,428 | B1 | 9/2004 | Ong | |
| 6,808,104 | B2 | 10/2004 | Cobble | |
| 7,140,644 | B2 * | 11/2006 | Hanes | 283/36 |
| 7,306,134 | B1 | 12/2007 | Ong | |
| 8,152,050 | B2 * | 4/2012 | Busam et al. | 229/67.1 |
| 2006/0076771 | A1 | 4/2006 | Schafer | |
| 2007/0012752 | A1 | 1/2007 | Lee | |

OTHER PUBLICATIONS

CA, Office Action, Canadian Application No. 2,629,583 (Nov. 25, 2010).
CA, Office Action, Canadian Application No. 2,629,583 (Nov. 7, 2011).
US, Office Action, U.S. Appl. No. 12/105,898 (May 19, 2011).
US, Office Action, U.S. Appl. No. 12/105,898 (Oct. 3, 2011).
US, Notice of Allowance, U.S. Appl. No. 12/105,898 (Jan. 12, 2012).

* cited by examiner

*Primary Examiner* — Nathan J Newhouse
*Assistant Examiner* — Derek Battisti
(74) *Attorney, Agent, or Firm* — Thompson Hine L.L.P.

(57) ABSTRACT

A pocket assembly includes a major panel and a pocket panel coupled together to define a pocket between the panels. A divider is placed in the pocket to partition the pocket into two or more compartments. The divider comprises a securing element secured to at least one of the major and pocket panels.

20 Claims, 21 Drawing Sheets

POCKET WITH SECURE DIVIDERS

CROSS-REFERENCE TO RELATED APPLICATION

This application is a continuation in part of U.S. application Ser. No. 12/105,898 filed on Apr. 18, 2008, now allowed which claims the benefit of the filing date of U.S. Provisional Application Ser. No. 60/913,118, entitled "Pocket with Secure Dividers" filed on Apr. 20, 2007, the entirety of which is incorporated herein by reference.

BACKGROUND

The present invention is directed to a pocket, and more particularly, to a pocket having dividers securely received therein.

Pockets may be used to store various items such as loose papers, writing utensils, or the like. Such pockets may include a divider or dividers positioned therein so that the contents of the pocket can be easily compartmentalized and organized. In addition, it may be desired to provide a secure attachment means such that the dividers are securely attached to the pocket and are not easily removed or torn.

SUMMARY

The present disclosure in one aspect provides a pocket assembly that includes a major panel and a pocket panel coupled together to define a pocket therebetween. A divider is placed in the pocket to partition the pocket into two or more compartments. The divider comprises a securing element secured to at least one of the major and pocket panels.

In one embodiment, the securing element may be a tab extending from the divider and attached to the at least one of the major and pocket panels. The pocket may be provided at its bottom (or at its side) with an opening while the tab may extend through the opening and may be attached to the outside surface of the at least one of the major and pocket panels. The tab may be folded flat against the outside surface of the at least one of the major and pocket panels to be attached thereto. The opening may be a slit formed along the bottom (or side) edge of the at least one of the major and pocket panels. The major and pocket panels may be pivotally secured together about the bottom (or side) edge.

In another embodiment, the divider may include at least one divider panel, and the tab may be coupled to the at least one divider panel along its lower (or side) edge. The divider may include two or more divider panels. First and second ones of the two or more divider panels may be foldably connected together along their common lower (or side) edge, and the tab may be formed from the first divider panel and joined to the second divider panel along the lower (or side) edge. The first and second divider panels may be folded about the common lower (or side) edge into a face-to-face relationship such that the tab protrudes downwardly (or sideways) from the second divider panel. Alternatively, the two or more divider panels may be separate panels, and each of them may have the tab so that the each divider may be individually coupled to the at least one of major and pocket panels by the tab of the each divider panel.

In a further embodiment, the major panel may include a set of openings formed therethrough. The openings may be positioned and aligned to allow the pocket assembly to be coupled to a binding mechanism.

In a still further embodiment, the pocket panel may be generally rectangular in shape. The pocket panel may be securely coupled to the major panel along at least two secured outer edges while leaving at least one free outer edge unattached to the major panel. The assembly may further comprise a side flap coupling one of the at least two secured outer edges of the pocket panel to the major panel to allow the pocket to expand.

The present disclosure in a second aspect provides a portfolio which includes a major panel and a pocket panel coupled together to define a pocket between the respective inside surfaces of the major and pocket panels. A divider is received in the pocket. The pocket panel is coupled to the major panel along its lower (or side) edge to define the bottom (or side) of the pocket. The pocket is provided at its bottom (or side) with an opening. The divider comprises a tab extending outwardly of the pocket through the opening and is attached to the outside surface of one of the major and pocket panels.

In one embodiment of this aspect, the pocket panel may be foldably coupled to the major panel along the lower (or side) edge. The opening may be formed along the lower (or side) edge, and the tab may be folded about the lower (or side) edge onto the outside surface of the one of the major and pocket panels to be attached to the outside surface.

In another embodiment, the portfolio may further include a second major panel foldably coupled to the first major panel. A spine may be positioned between the first and second major panels. Further, a binding mechanism may be mounted to one of the spine and either one of the first and second major panels. A second pocket panel may be coupled to the second major panel to define a second pocket between the second major panel and the second pocket panel. In such an embodiment, a second divider may be received in the second pocket. The second pocket panel may be provided at the bottom (or side) thereof with an opening. The second divider may comprise a tab extending outwardly of the second pocket through the opening of the second pocket. The tab of the second divider may be attached to the outside surface of one of the second major and second pocket panels.

In a further embodiment, the portfolio may further comprise a closure flap pivotally coupled to the upper edge of the first major panel. The closure flap may include a locking tongue while the pocket panel may have a tongue socket engageable with the locking tongue.

DETAILED DESCRIPTION

Figure 1:
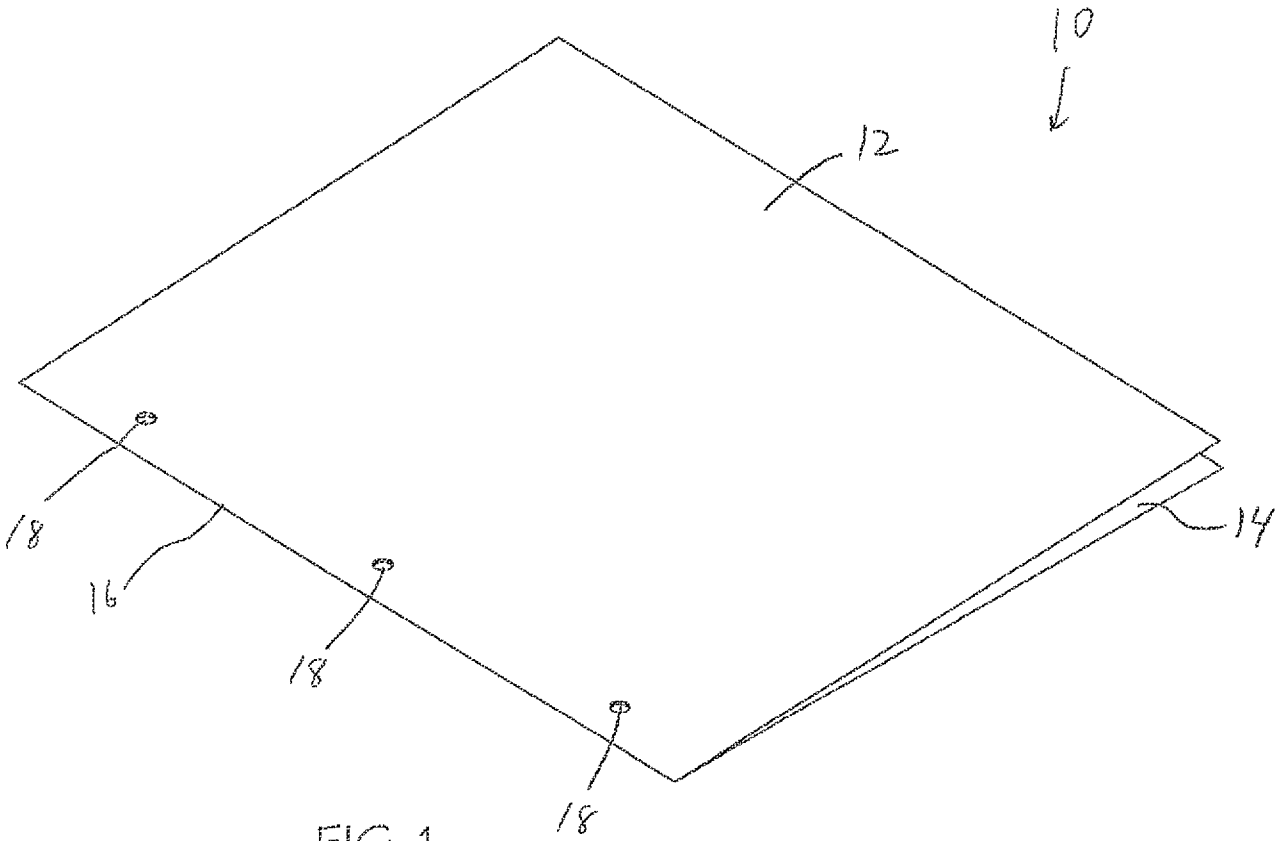
FIG. 1 is a front perspective view of a portfolio in a closed position incorporating a pocket/divider design.
Figure 2:
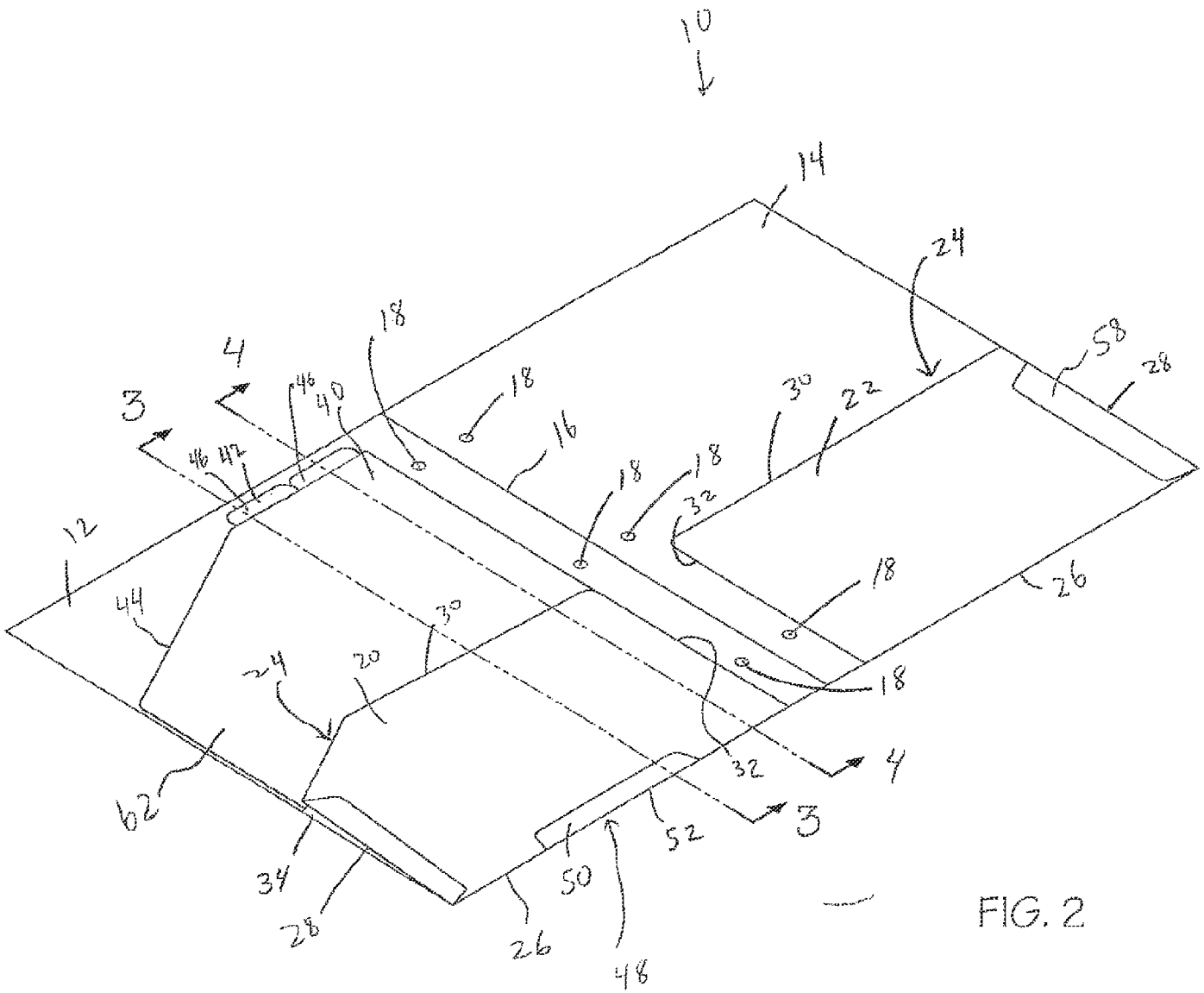
FIG. 2 is a front perspective view of the portfolio of FIG. 1 shown in its open position.
Figure 3:
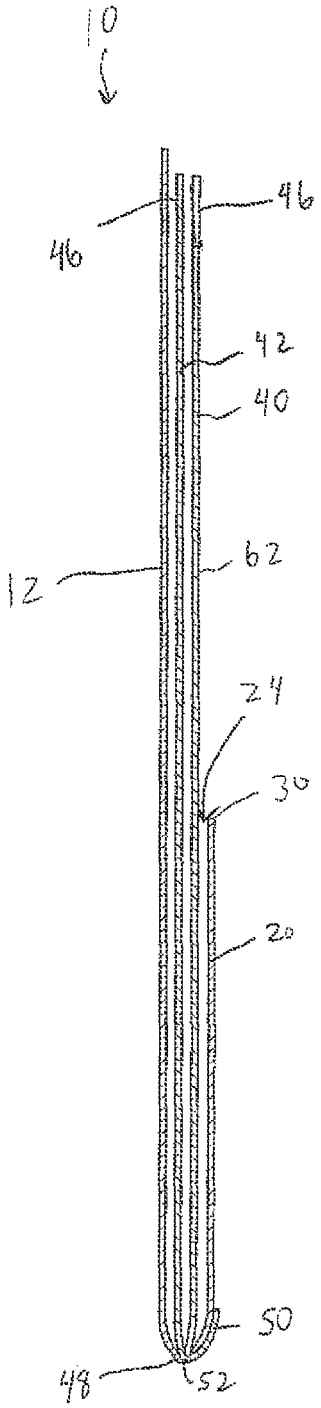
FIG. 3 is a side cross-section taken along line 3-3 of FIG. 2.
Figure 4:
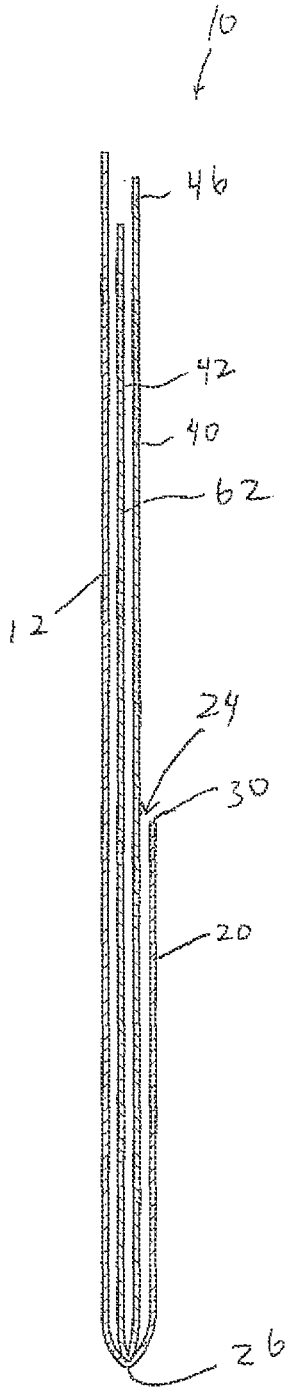
FIG. 4 is a side cross-section taken along line 4-4 of FIG. 2.

FIGS. 1-4 illustrate a portfolio, generally designated 10, including a pair of opposed major panels 12, 14. The major panels 12, 14 are pivotally attached to each other along a central fold line 16. In this manner, each major panel 12, 14 is independently pivotable about the fold line 16 such that the portfolio 10 is moveable between a closed position (FIG. 1) wherein the major panels 12, 14 are generally parallel, aligned and face each other, and an open position (FIG. 2) wherein the major panels 12, 14 lay generally flat and coplanar and do not face each other.

If desired, a spine (not shown) may be positioned between the major panels 12, 14. Further, if desired, a binding mechanism (not shown) may be mounted to the spine or to either of the major panels 12, 14. In the illustrated embodiment, each of the major panels 12, 14 includes a set of openings 18 formed therethrough, wherein the openings 18 are positioned and aligned to allow the portfolio 10 to be coupled to a three-ring binding mechanism or the like.

A generally rectangular pocket panel 20, 22 is attached to the inner surface of each associated major panel 12, 14 to define a pocket 24 therebetween. More particularly, each pocket panel 20, 22 may be securely coupled to the underlying major panel 12, 14 along two secured edges (i.e. a bottom edge 26 and an outer edge 28), leaving two free edges (top edge 30 and inner edge 32) along which the associated pocket 24 can be accessed. In the illustrated embodiment, an expandable gusset or side flap (such as an accordion-style gusset) 34 is coupled to the outer edge 28 of the pocket panel 20 to allow the associated pocket 24 to expand as desired.

A set of dividers 40, 42 may be positioned in the pocket 24. In the illustrated embodiment, each of the dividers 40, 42 is generally rectangular, having an angled corner 44 and a protruding tab 46. In the illustrated embodiment, each divider 40, 42 is made of a generally transparent material although, if desired, the dividers 40, 42 can be made of opaque or various other materials.

Each divider 40, 42 may have a width (i.e. in the left-to-right direction of FIGS. 2 and 5) about equal to the width of the associated pocket panel 20/major panel 12 to allow the contents of the pocket 24 to be completely divided/segregated. More particularly, in one embodiment, each divider 40, 42 may have a width within at least about 10% or at least about 20%, or at least about 30% of the width of the associated pocket panel 20 and/or major panel 12. Furthermore, each divider 40, 42 may have a height (i.e. extending in the top-to-bottom direction of FIGS. 2 and 5) close to the height of the portfolio 10/major panels 12, 14 such that the dividers 40, 42 can extend through a stack of loose leaf papers of various heights stored in the associated pocket 24. Thus, in one embodiment, each divider 40, 42 may have a height within at least about 10%, or at least about 20%, or at least about 30%, of the height of the portfolio 10 and/or associated major panel 12.

Figure 5:
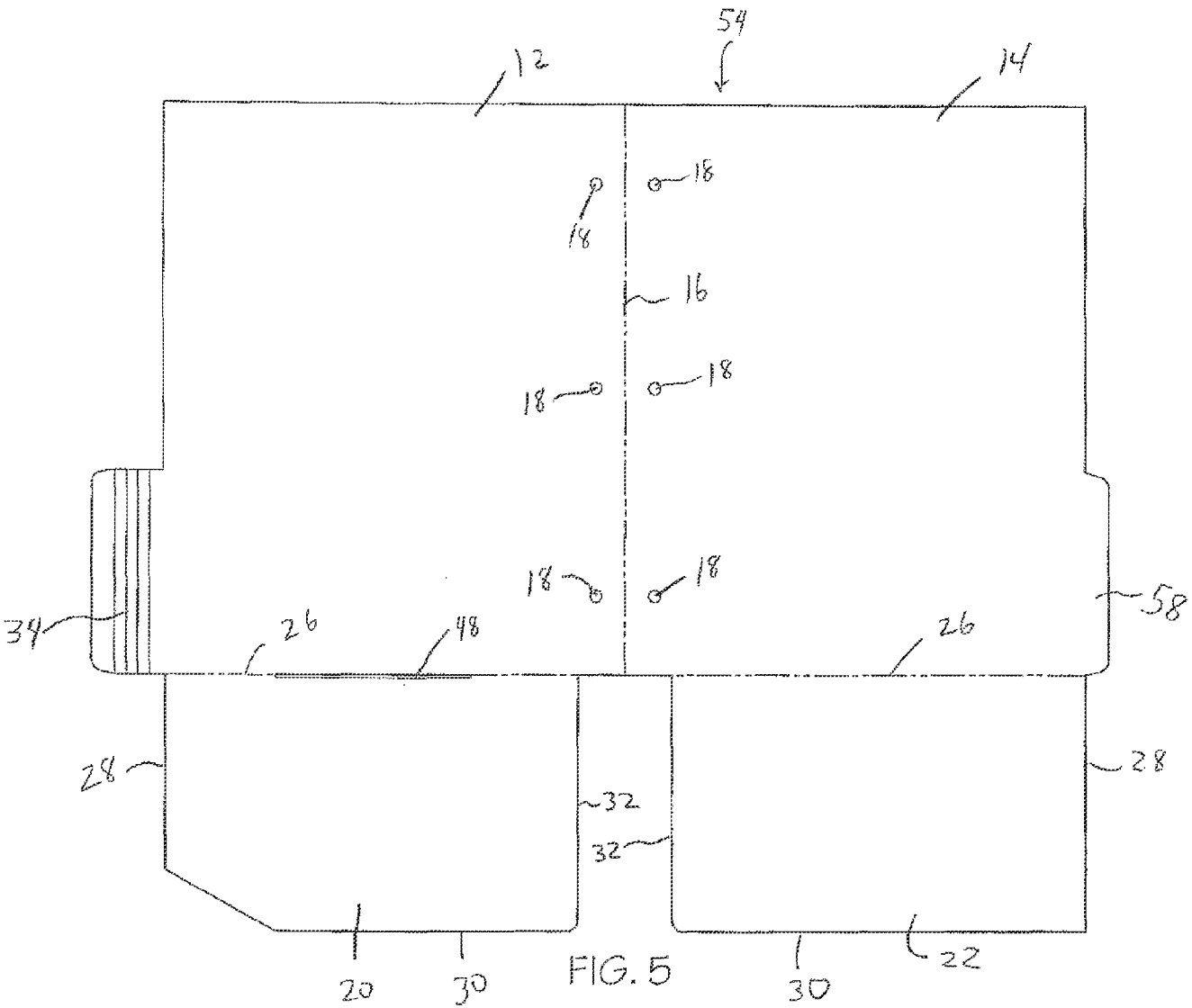
FIG. 5 is a top view of a blank which can be used to form the portfolio of FIGS. 1 and 2.
Figure 8:
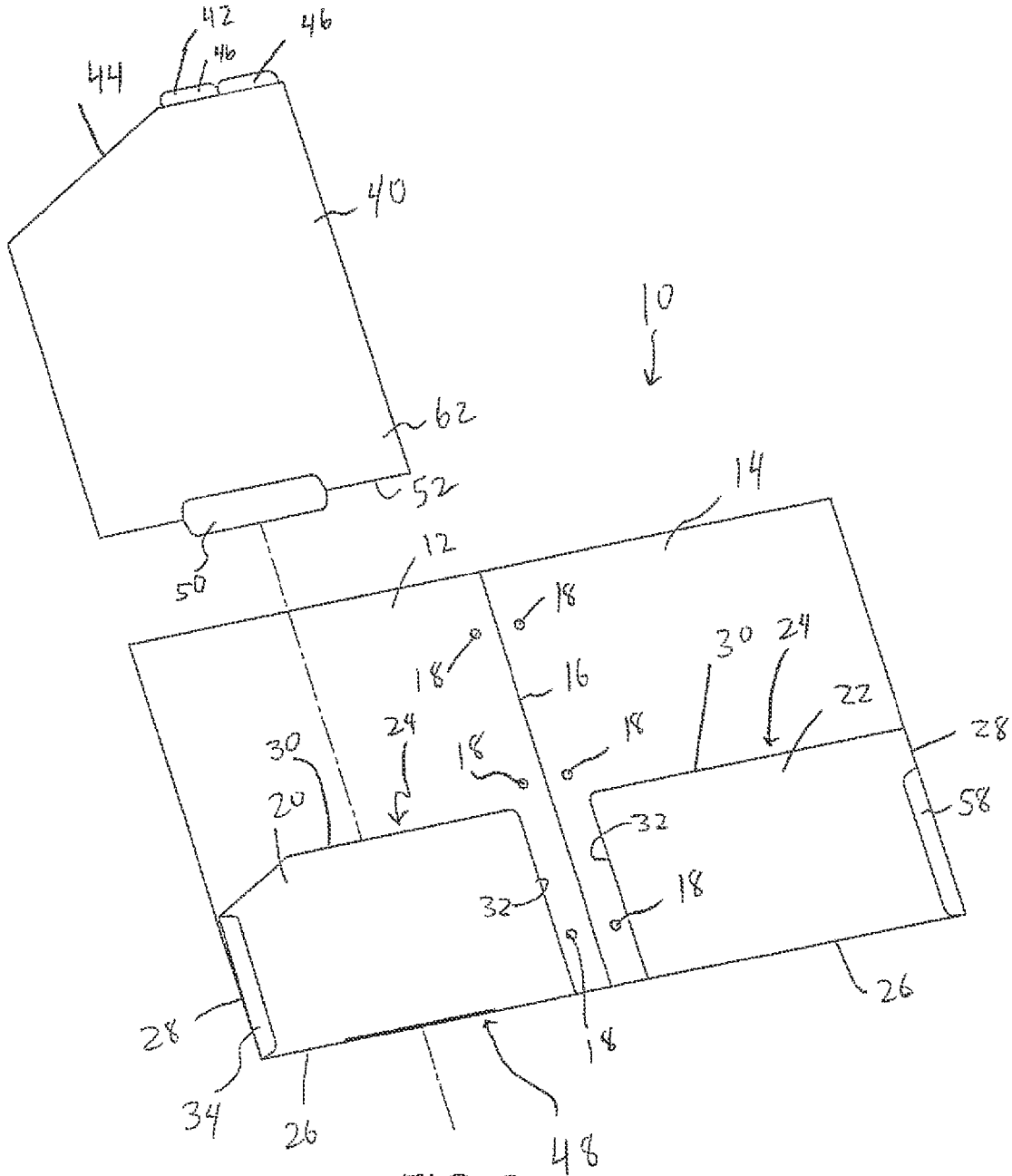
FIG. 8 is a front perspective view of the folded dividers of FIG. 7 positioned above the assembled portfolio of FIG. 5.

The pocket 24 defined by pocket panel 20 has a narrow opening or slit 48 formed along its bottom edge 26, as best shown in FIGS. 5 and 8. At least one of the dividers 40, 42 includes a tab portion 50 which protrudes through the opening 48 and is folded flat against the outer surface of the pocket panel 20. The tab 50 may then be attached to the underlying pocket panel 20 to securely couple the tab 50/divider(s) 40, 42 to the portfolio 10/pocket panel 20. The tab 50 can be attached to portfolio 10/pocket panel 20 by any of a wide variety of methods, such as heat welding, sonic welding, stitching, adhesives, staples, rivets or other mechanical fasteners, etc.

The tab 50 may have a relatively long length (i.e. extending along the left-to-right direction of FIG. 2) to ensure adequate coupling strength. More particularly, the tab 50 may extend along at least about 10%, or at least about 20% or at least about 30%, or at least about 40% of the width (i.e. extending in the left-to-right direction of FIG. 2) of the associated major panel 12, pocket panel 20 and/or divider 40, 42. The opening 48 may have a length that is about equal to the length of the associated tab 50 (i.e. within about 10% of the length of the tab 50) such that the opening 48 closely receives the tab 50 therethrough.

In this manner, the tab 50 securely retains the divider(s) 40, 42 to the portfolio 10/pocket panel 20. More particularly, the tab 50 provides an attachment structure that can be easily accessed and formed during manufacturing/assembly. Furthermore, because the tab 50 is folded about a bottom edge 26 of the pocket panel 20, the fold 52 provides further secure attachment. For example, the fold 52 of the tab 50 may accommodate stresses if the divider(s) 40, 42 are attempted to be pulled upwardly out of the associated pocket 24.

In order to assemble the portfolio of FIGS. 1-4, in one embodiment the blank 54 of FIG. 5 may be provided. Each pocket panel 20, 22 may be pivoted about the lower edge 26 of the associated major panel 12, 14 such that the pocket panels 20, 22 lay generally flat against the associated major panel 12, 14. The gusseted side flap 34 and opposite side flap 58 are then pivoted inwardly until each side flap 34, 58 lays on top of the associated pocket panel 20, 22. The side flaps 34, 58 are then attached to the associated pocket panel to complete the pockets 24 and provide the portfolio 10 shown in, for example, FIG. 8.

Figure 6:
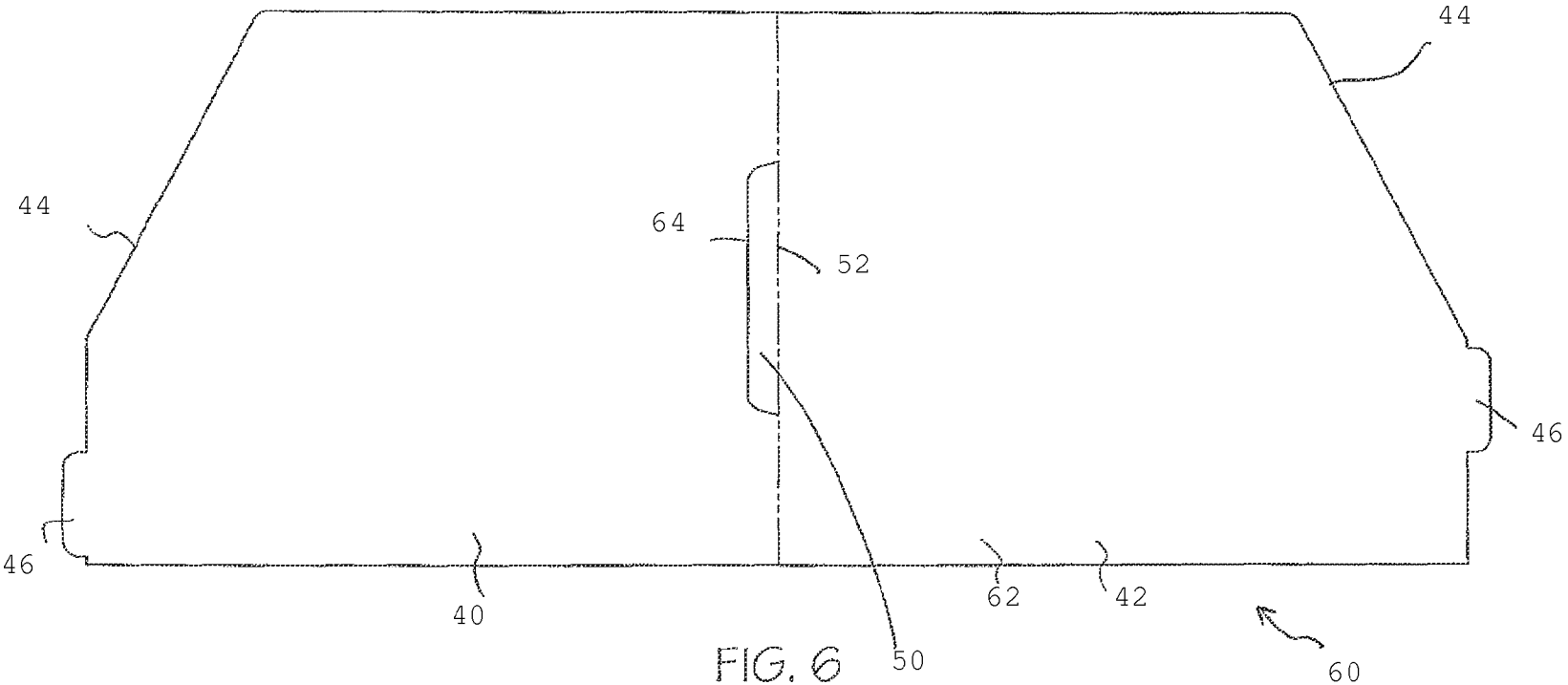
FIG. 6 is a top view of a blank which can be used to form the dividers shown in FIGS. 2-4.
Figure 7:
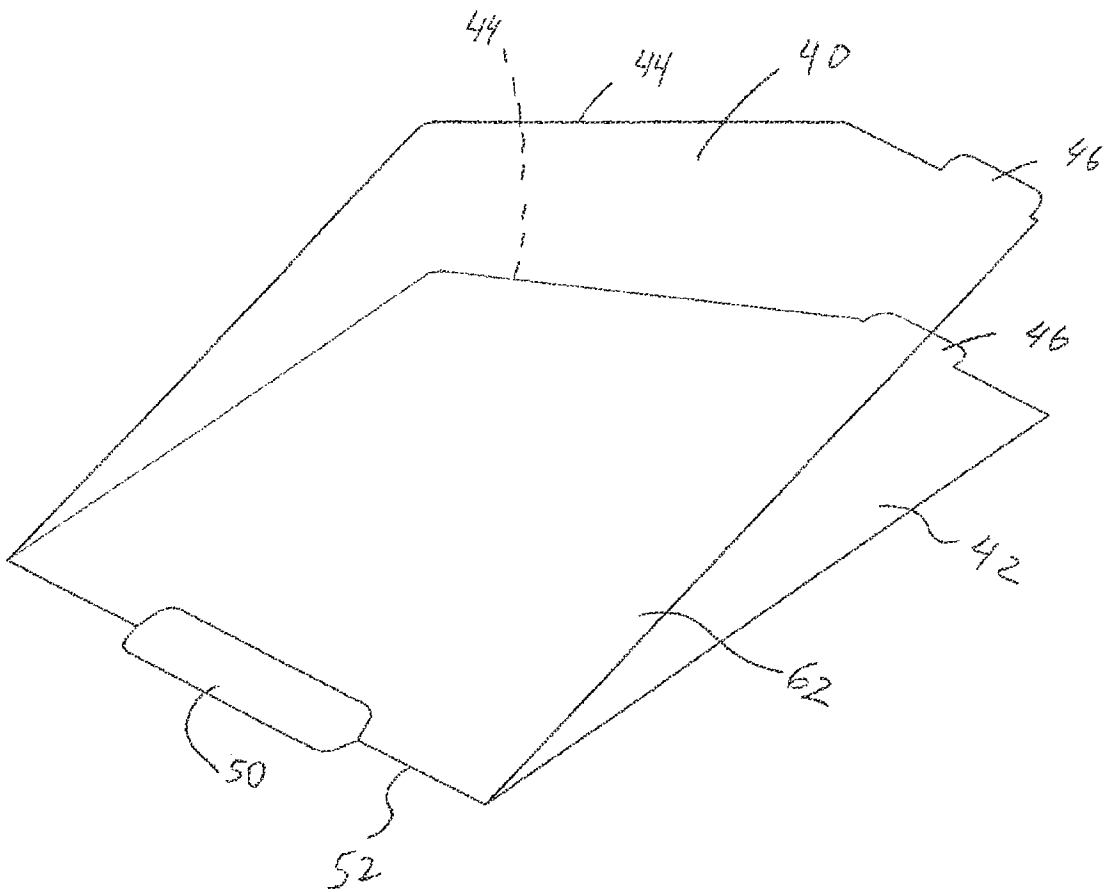
FIG. 7 is a front perspective view of the dividers of FIG. 6, shown in a partially folded state.

Next, as shown in FIG. 6, in one embodiment a blank 60 for forming the dividers 40, 42 may be provided. In the illustrated embodiment, the dividers 40, 42 are formed from a single, unitary piece of sheet-like material 62. A generally "U"-shaped cut 64 is formed in the blank 60 to define the tab 50 which is positioned adjacent to a central fold line 52 of the blank 60. Next, as shown in FIG. 7, the blank 60 is folded about the central fold line 52 such that the tab 50 protrudes downwardly from the dividers 40, 42. Thus, in the illustrated embodiment, the tab 50 is formed as a single piece that is unitary with at least one divider 40, 42, or with both dividers 40, 42.

Figure 9:
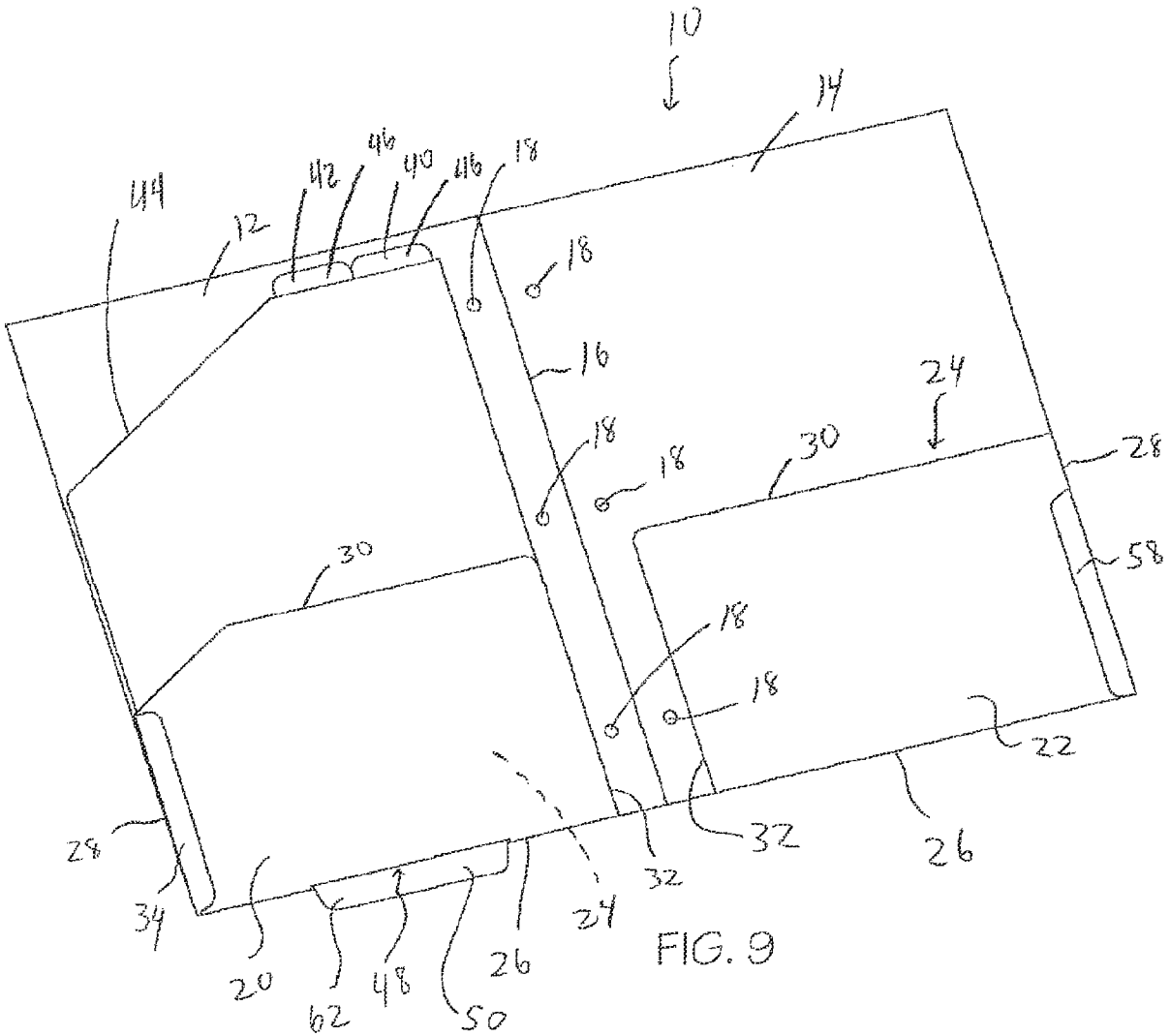
FIG. 9 is a front perspective view of the dividers and the portfolio of FIG. 8 in an assembled condition.

Next, as shown in FIG. 8, the assembled dividers 40, 42 are positioned above the assembled portfolio 10 and the dividers 40, 42 are inserted into the associated pocket 24 such that the tab 50 protrudes through the opening 48 (FIG. 9). The tab 50 is then folded upwardly and coupled to the outer surface of the pocket panel 20, resulting in the assembly shown in FIG. 2. However, the tab 50 could alternately be folded in the opposite direction such that the tab 50 wraps around the outer surface of the major panel 12.

The portfolio 10 (i.e. including major panels 12, 14, pocket panels 20, 22, side flaps 34, 58, spine, etc.), along with the dividers 40, 42 can be made of any of a wide variety of materials, including but not limited to plastic (such as polypropylene or vinyl), cardboard, paperboard, plastic encased cardboard, etc. In addition, the components of the portfolio 10 and dividers 40, 42 can be attached/assembled by any of a wide variety of methods, such as heat welding, sonic welding, stitching, adhesive, staples, rivets or other mechanical fasteners, etc. Further, while the illustrated embodiment shows only pocket panel 20 receiving the dividers 40, 42 therein, if desired, both pocket panels 20, 22 or only pocket panel 22 may receive the dividers 40, 42.

Figure 10:
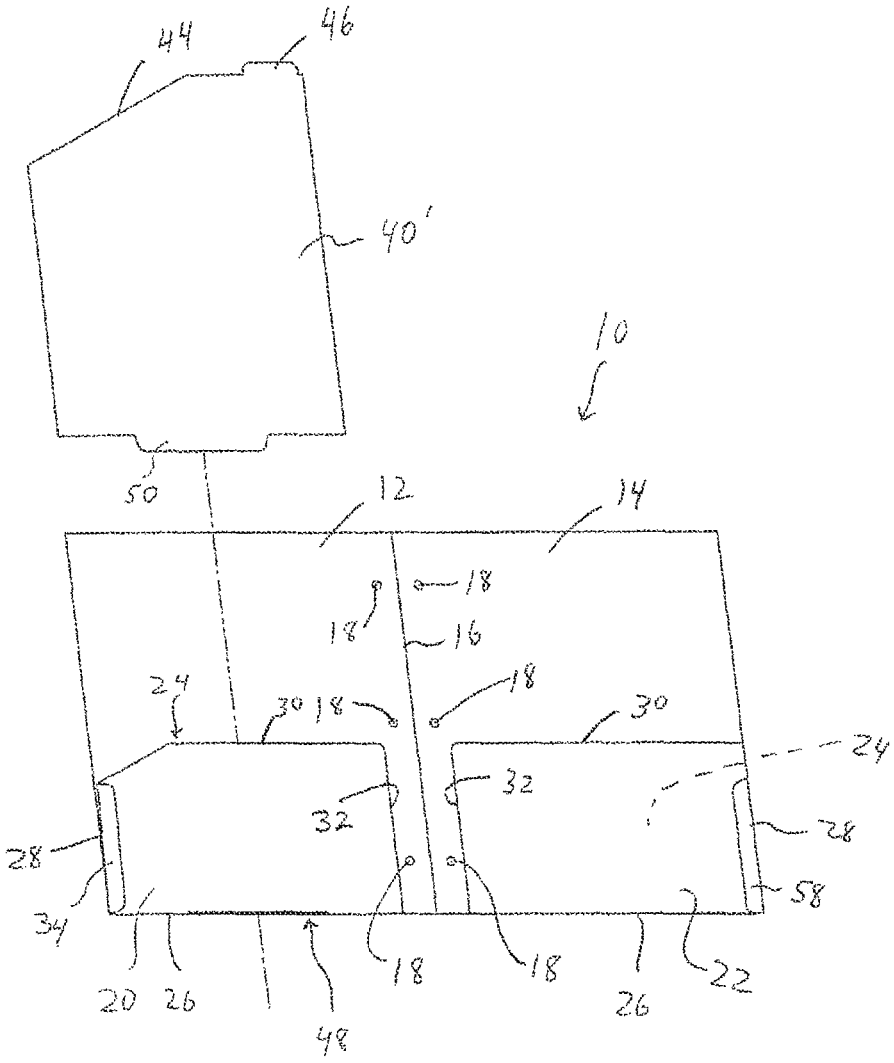
FIG. 10 is a front perspective view of a portfolio and a single-ply divider exploded away from the portfolio.

FIG. 10 illustrates another embodiment of the invention, wherein only a single divider 40 having a tab 50 is configured to be coupled to the portfolio. If desired, multiple of the single-ply dividers 40 of FIG. 10 can be coupled to the portfolio 40, wherein each divider 40 includes its own associated tab 50. This arrangement may provide greater strength in that each divider 40 is individually coupled by its own tab 50. However, the embodiment shown in FIGS. 6 and 7 (wherein two dividers 40, 42 share a tab 50) may be advantageous that only a single blank 60 and relatively few steps are required to produce a dual divider assembly.

Figure 11:
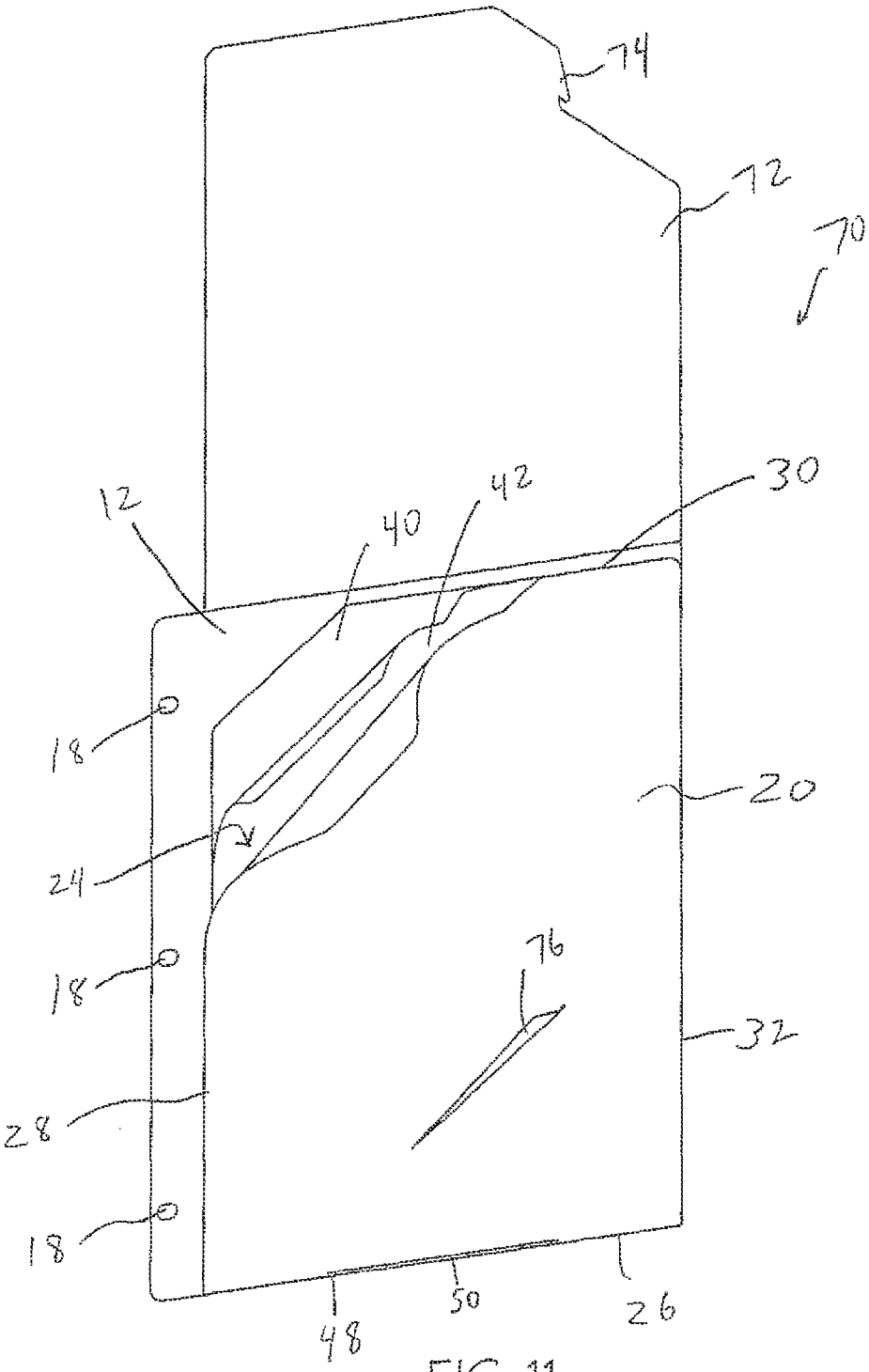
FIG. 11 is a front perspective view of another portfolio utilizing a pocket and divider design.
Figure 12:
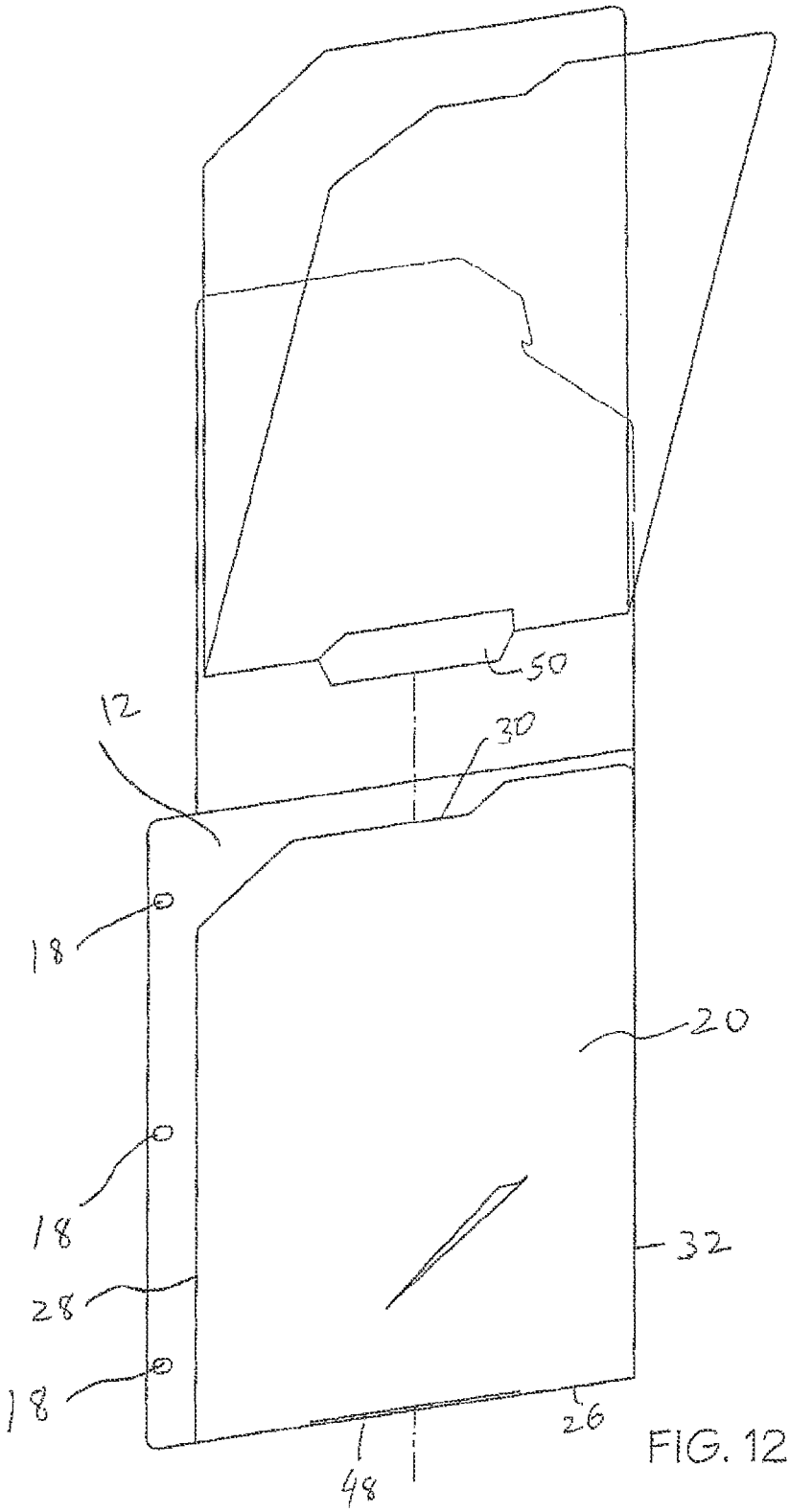
FIG. 12 is a front perspective view of the portfolio of FIG. 11 shown in an opened position with the dividers exploded away from the pocket.

FIGS. 11 and 12 illustrate another embodiment of the invention wherein a portfolio 70 includes a major panel 12, a pocket panel 20 defining a pocket 24 therebetween, and a pair of dividers 40, 42 received in the pocket 24. In this embodiment, the pocket panel 20 is relatively large, having a surface area of about equal to the surface area of the major panel 12. The pocket panel 20 is secured to the underlying major panel 12 about bottom edge 26 and side edge 32 thereby leaving top edge 30 and inner edge 28 as free edges. A closure flap 72 is pivotally coupled to an upper edge of the major panel 12.

The closure flap 72 may include a tooth or locking element 74 that can be inserted into and through an opening or socket 76 of the pocket panel 20 to thereby secure the portfolio 70 in a closed position. However, any of a variety of closure mechanisms, such as hook-and-loop fasteners (such as VELCRO®), clasps, hooks, loops, elastic components, brackets, magnets, interengaging geometries or the like may be used to retain the closure flap 72 in a closed position. The dividers 40, 42, having a configuration and assembly similar to the dividers 40, 42 shown in FIGS. 6 and 7 and described above, may be received in the pocket 24 and coupled to the pocket 24 by the tab 50 extending through the opening 48 of the pocket 24. In the embodiment shown in FIGS. 11 and 12, the tab 50 is folded rearwardly about the major panel 12 and attached thereto, such that the tab is generally not visible in FIG. 11.

Figure 13:
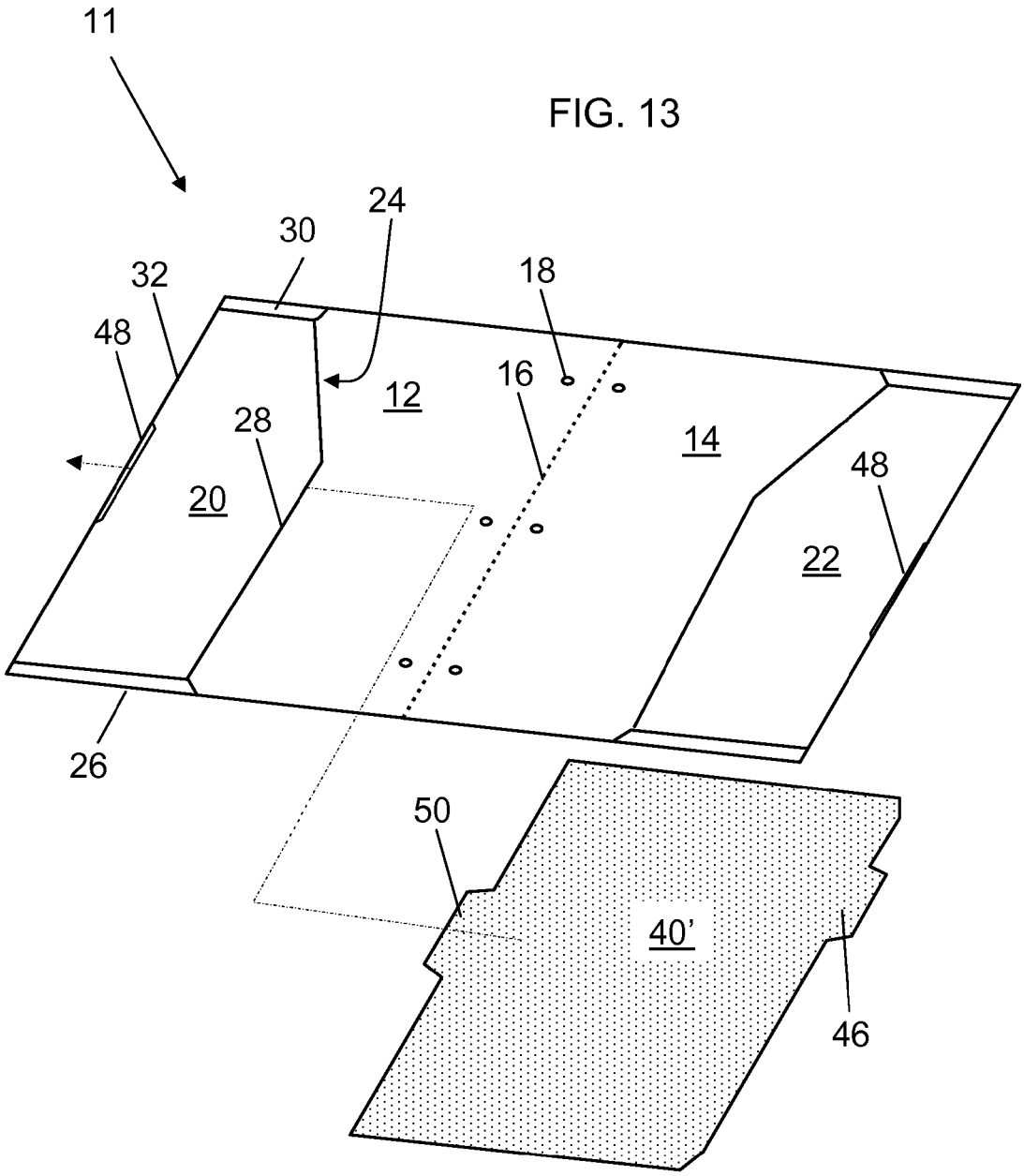
FIG. 13 is a front perspective view of another portfolio and a single-ply divider exploded away from the portfolio.
Figure 14:
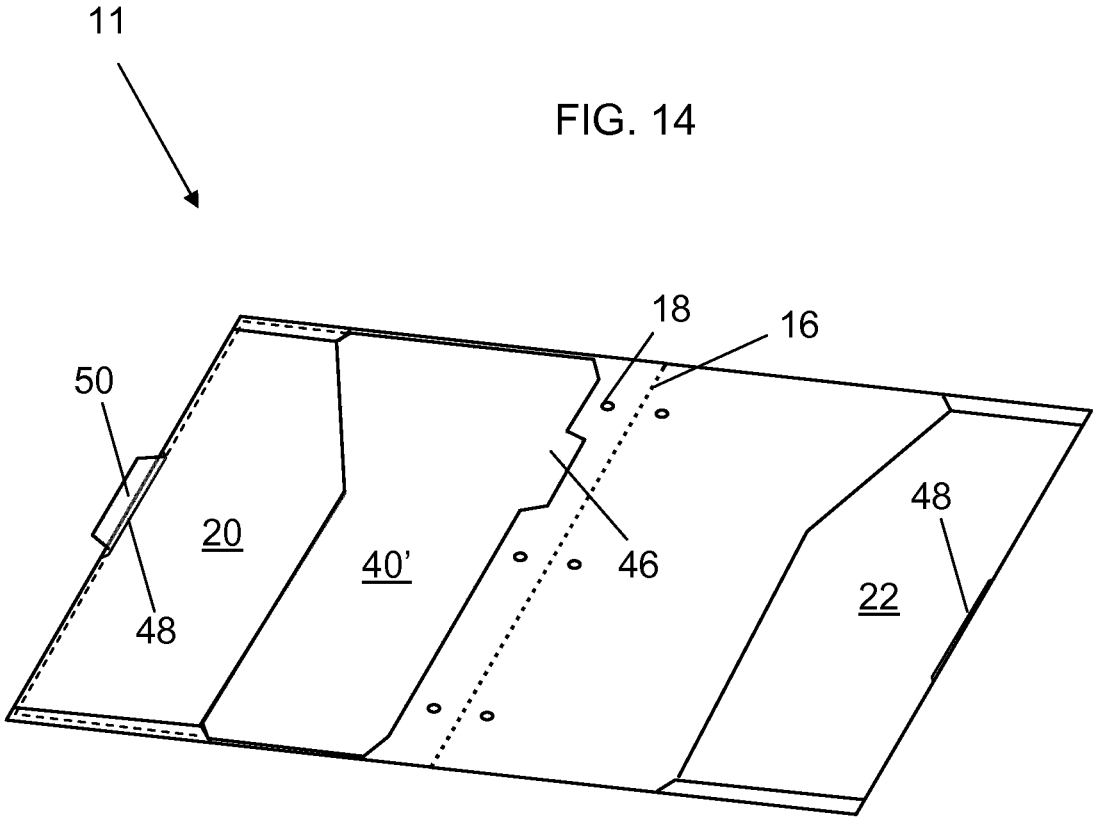
FIG. 14 is a front perspective view of the portfolio of FIG. 13 with the single-ply divider inserted into the portfolio.
Figure 15:
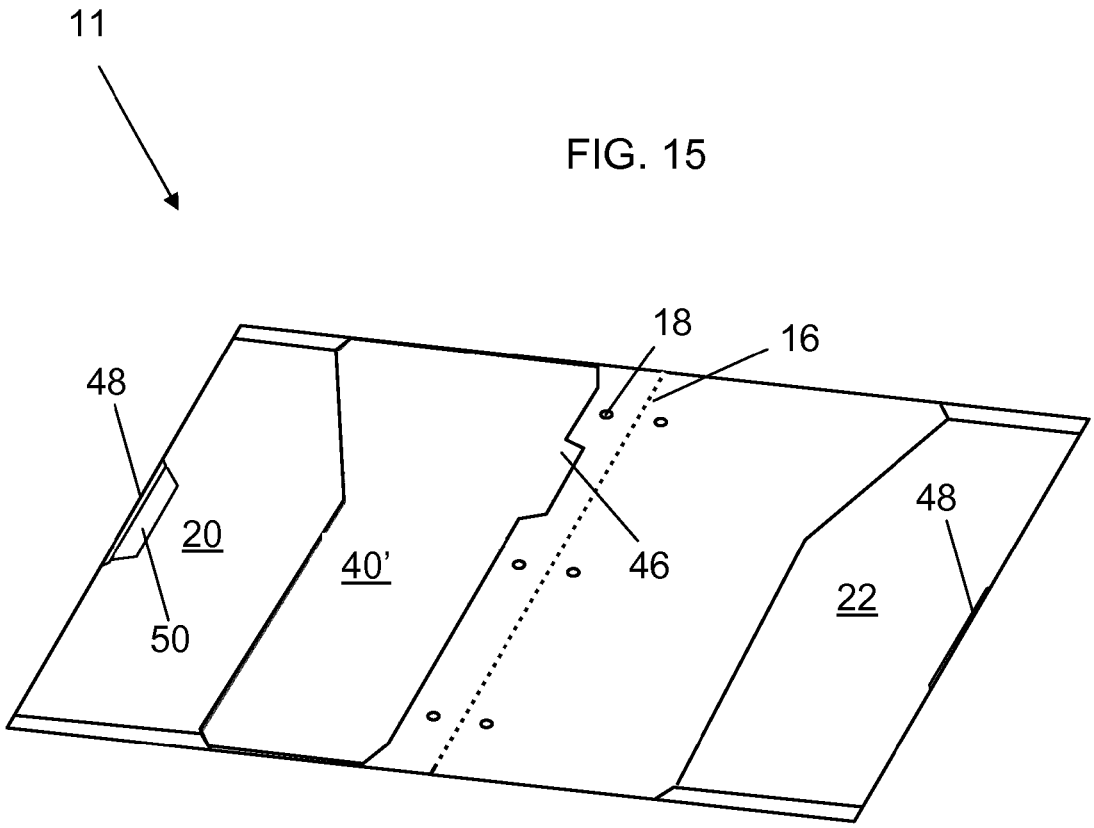
FIG. 15 is a front perspective view of the portfolio of FIG. 14 with the single-ply divider attached into the portfolio.

FIGS. 13-15 illustrate another embodiment of the invention wherein the portfolio 11 includes a major panel 12, a pocket panel 20 defining a pocket 24 therebetween, and divider 40' received in the pocket 24. In this embodiment, the pocket panel 20 as shown may have a surface area of about half the surface area of the major panel 12. However, the size of the pocket panel may be chosen according to manufacturing preference. The pocket panel 20 may be secured to the underlying major panel 12 about side edge 32 and one or both of bottom edge 26 and top edge 30, thereby leaving inner edge 28 as a free edge. Divider 40' may then be placed into pocket 24 so that tab 50 passes through opening 48 (FIG. 14). Tab 50 may then be folded upwardly and coupled to the outer surface of the pocket panel 20, resulting in the assembly shown in FIG. 15. However, the tab 50 could alternately be folded in the opposite direction such that the tab 50 wraps around to and may be attached to the outer surface of the major panel 12. A second divider (not shown) may be likewise placed in a pocket formed between pocket panel 22 and major panel 14.

Figure 16:
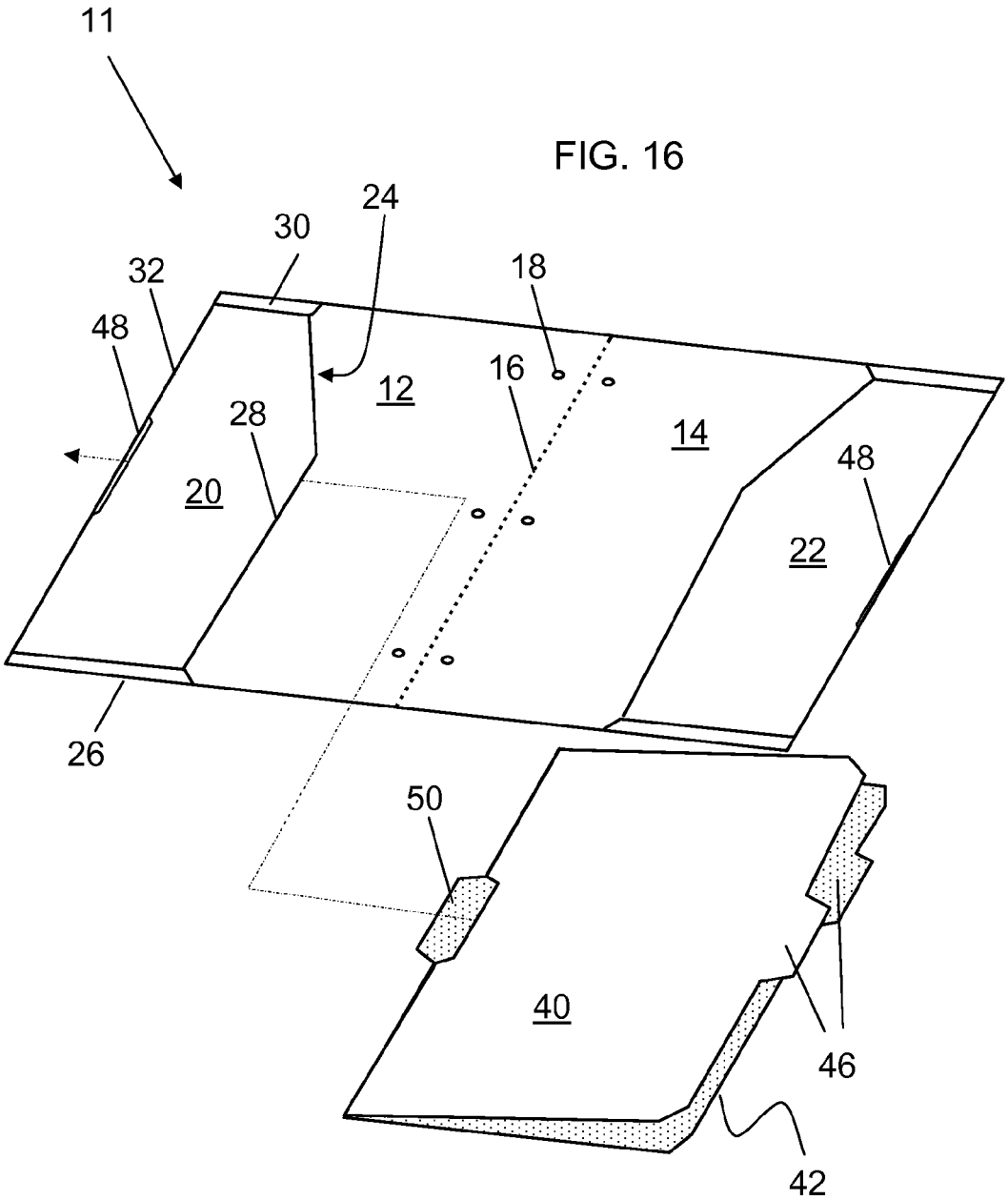
FIG. 16 is a front perspective view of another portfolio and a double-ply divider exploded away from the portfolio.

FIG. 16 illustrates another embodiment of the invention wherein the portfolio 11 includes a major panel 12, a pocket panel 20 defining a pocket 24 therebetween, and dividers 40, 42 received in the pocket 24. In this embodiment, the pocket panel 20 as shown may have a surface area of about half the surface area of the major panel 12. The pocket panel 20 may be secured to the underlying major panel 12 about side edge 32 and one or both of bottom edge 26 and top edge 30, thereby leaving inner edge 28 as a free edge. Dividers 40, 42 may then be placed into pocket 24 so that tab 50 passes through opening 48 (similarly to FIG. 14). Tab 50 may then be folded upwardly and coupled to the outer surface of the pocket panel 20, resulting in the assembly shown in FIG. 15. However, the tab 50 could alternately be folded in the opposite direction such that the tab 50 wraps around to and may be attached to the outer surface of the major panel 12. A second pair of dividers (not shown) may likewise be attached into the pocket between pocket panel 22 and major panel 14.

Figure 17:
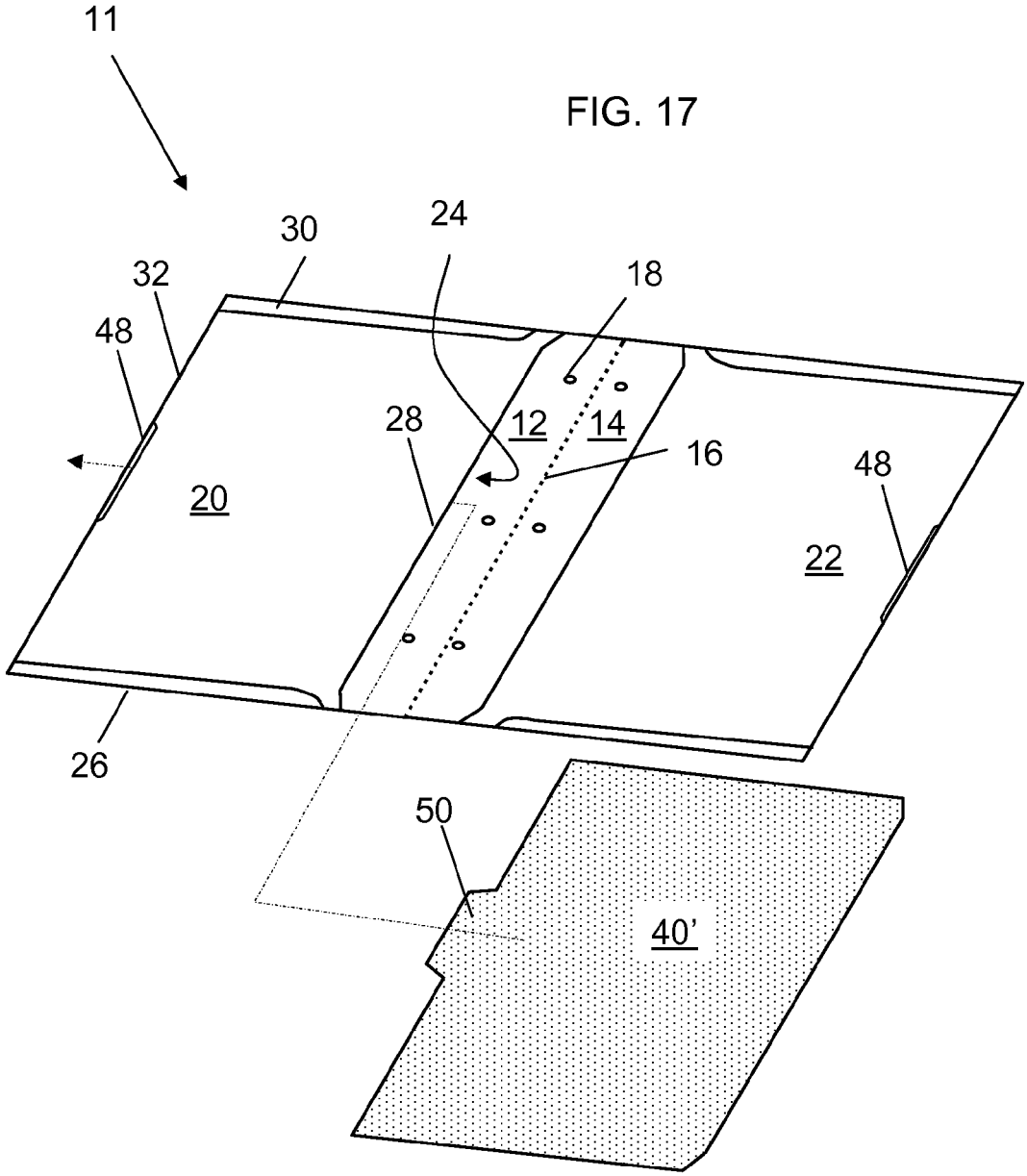
FIG. 17 is a front perspective view of another portfolio and a single-ply divider exploded away from the portfolio.
Figure 18:
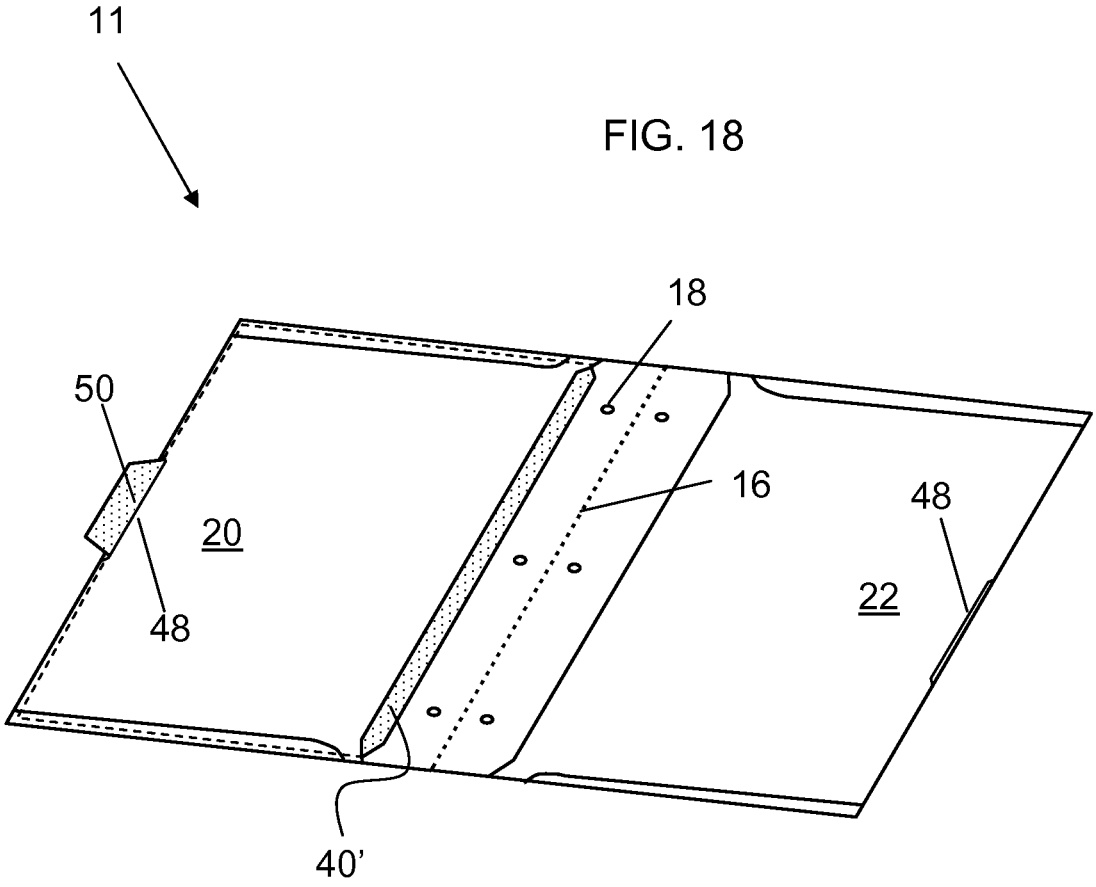
FIG. 18 is a front perspective view of the portfolio of FIG. 17 with the single-ply divider inserted into the portfolio.
Figure 19:
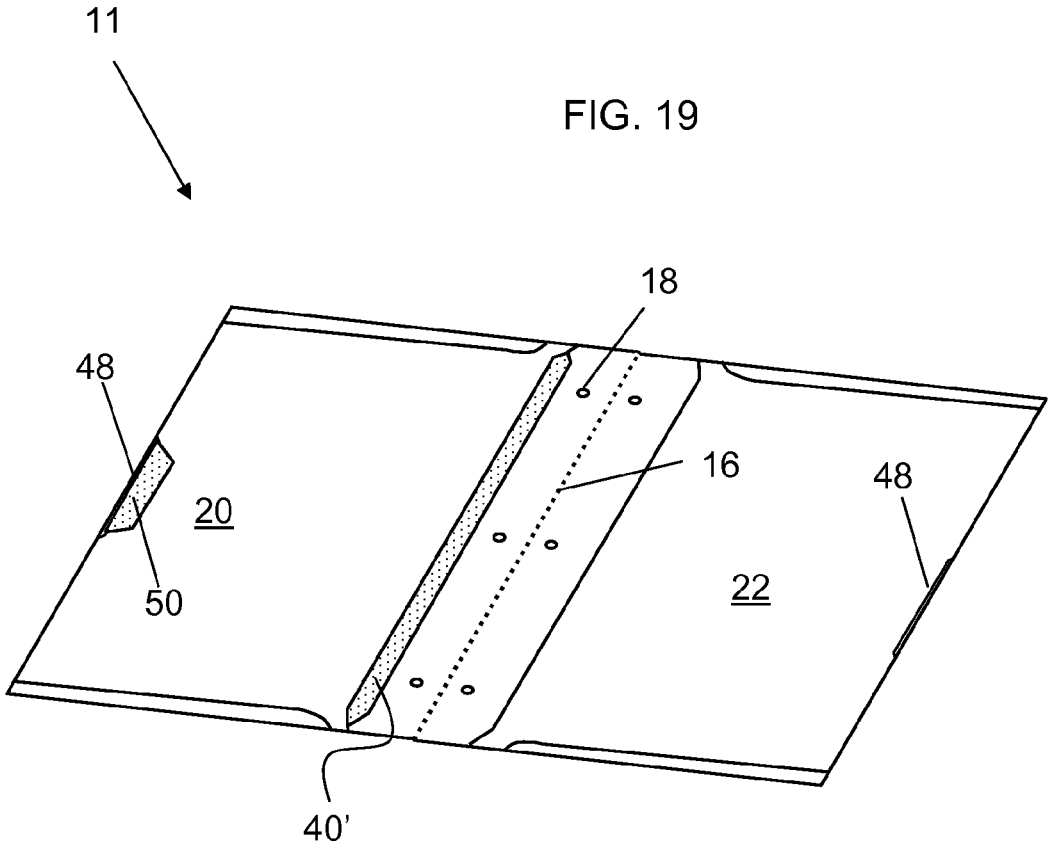
FIG. 19 is a front perspective view of the portfolio of FIG. 18 with the single-ply divider attached into the portfolio.

FIGS. 17-19 illustrate another embodiment of the invention wherein the portfolio 11 includes a major panel 12, a pocket panel 20 defining a pocket 24 therebetween, and divider 40' received in the pocket 24. In this embodiment, the pocket panel 20 has a surface area almost as large as the surface area of the major panel 12. However, the size of the pocket panel may be chosen according to manufacturing preference. The pocket panel 20 may be secured to the underlying major panel 12 about side edge 32 and one or both of bottom edge 26 and top edge 30, thereby leaving inner edge 28 as a free edge. Divider 40' may then be placed into pocket 24 so that tab 50 passes through opening 48 (FIG. 18). Tab 50 may then be folded upwardly and coupled to the outer surface of the pocket panel 20, resulting in the assembly shown in FIG. 19. However, the tab 50 could alternately be folded in the opposite direction such that the tab 50 wraps around to and may be attached to the outer surface of the major panel 12. A second divider (not shown) may be likewise placed in a pocket formed between pocket panel 22 and major panel 14. Alternately one or both of the dividers 40' may be replaced by a double divider 40, 42 as shown in FIG. 16.

Figure 20:
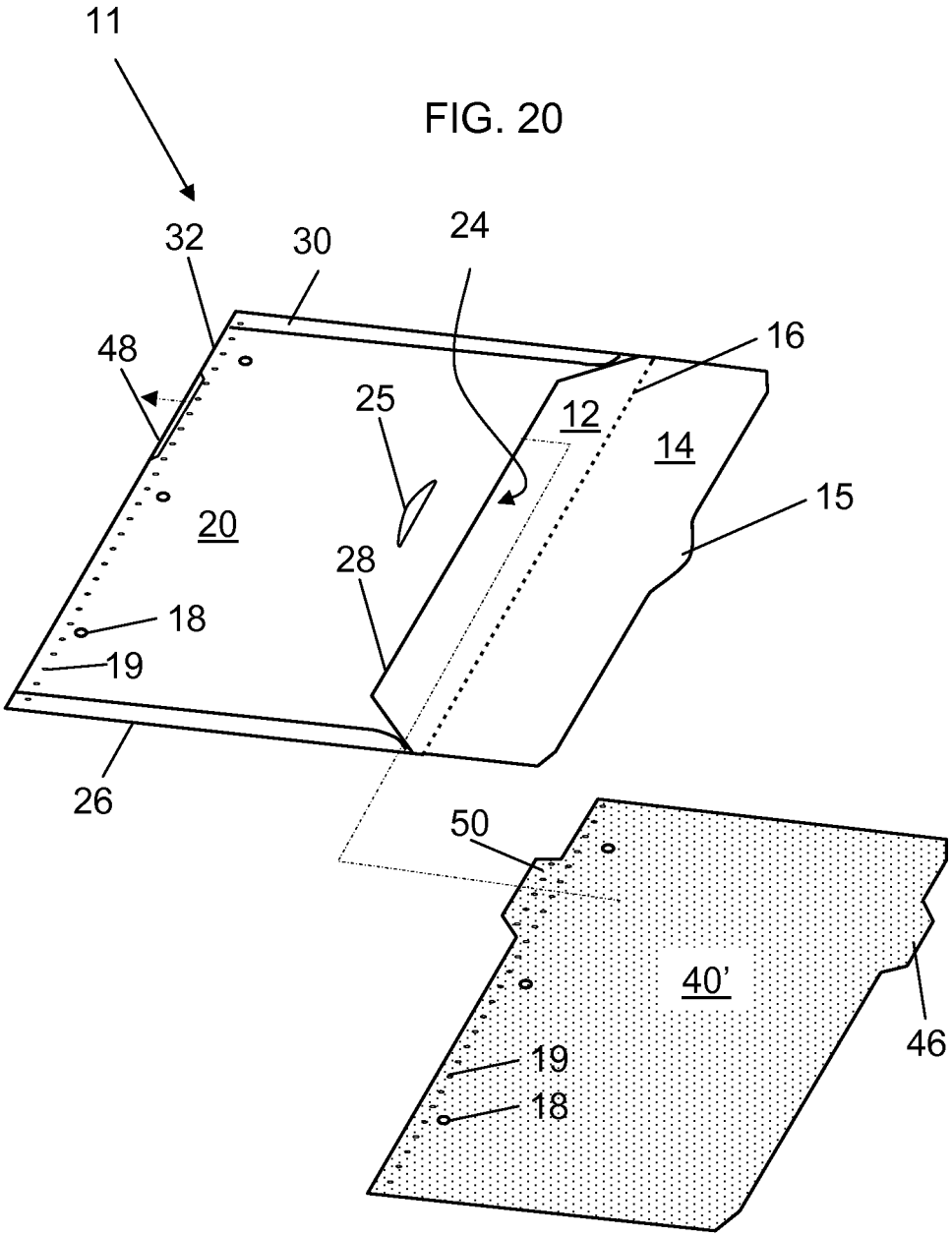
FIG. 20 is a front perspective view of another portfolio and a single-ply divider exploded away from the portfolio.
Figure 21:
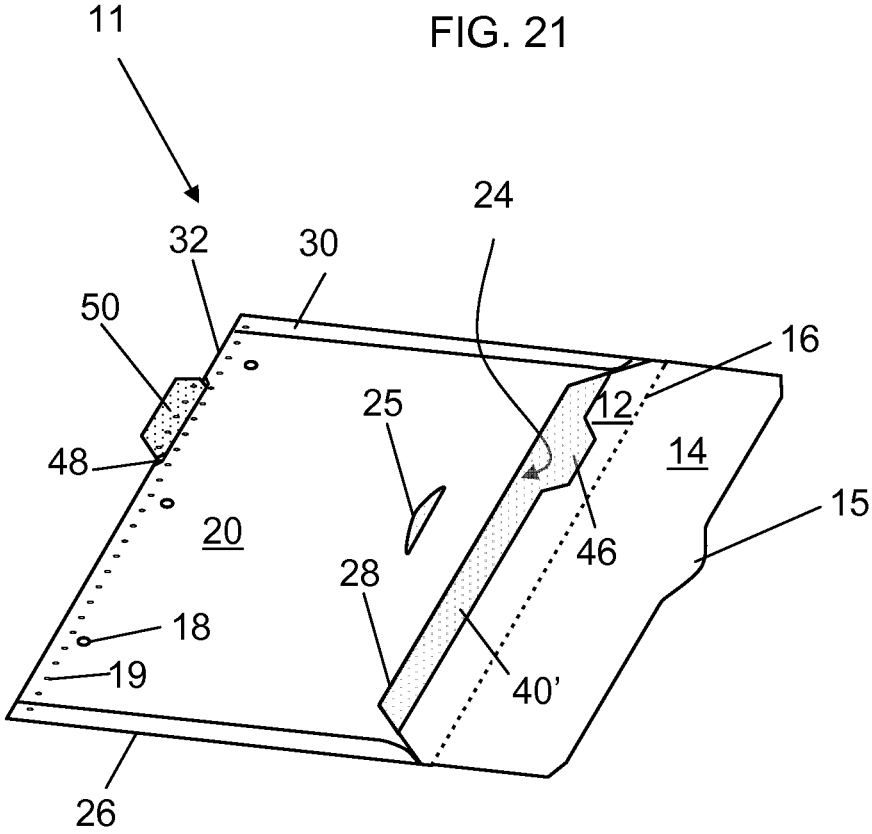
FIG. 21 is a front perspective view of the portfolio of FIG. 20 with the single-ply divider inserted into the portfolio.
Figure 22:
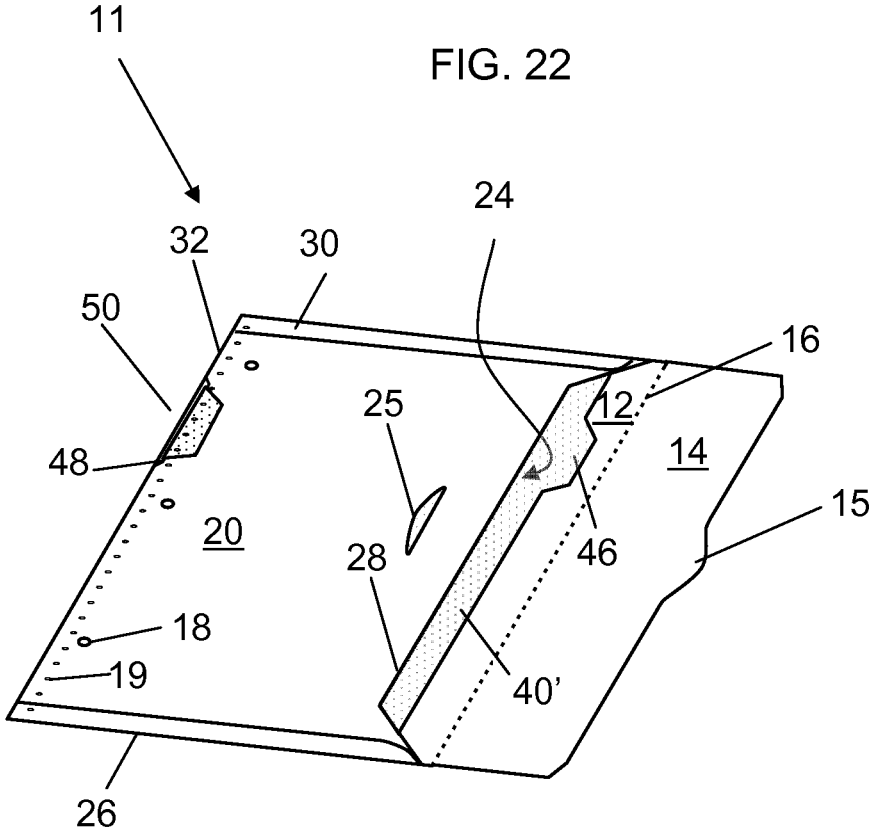
FIG. 22 is a front perspective view of the portfolio of FIG. 21 with the single-ply divider attached into the portfolio.

FIGS. 20-22 illustrate another embodiment of the invention wherein the portfolio 11 includes a major panel 12, a pocket panel 20 defining a pocket 24 therebetween, and divider 40' received in the pocket 24. In this embodiment, the pocket panel 20 has a surface area almost as large as the surface area of the major panel 12. However, the size of the pocket panel may be chosen according to manufacturing preference. The pocket panel 20 may be secured to the underlying major panel 12 about side edge 32 and one or both of bottom edge 26 and top edge 30, thereby leaving inner edge 28 as a free edge. Divider 40' may then be placed into pocket 24 so that tab 50 passes through opening 48 (FIG. 21). Tab 50 may then be folded upwardly and coupled to the outer surface of the pocket panel 20, resulting in the assembly shown in FIG. 22. However, the tab 50 could alternately be folded in the opposite direction such that the tab 50 wraps around to and may be attached to the outer surface of the major panel 12. Alternately divider 40' may be replaced by a double divider 40, 42 as shown in FIG. 16.

The pocket 24 may be covered by a cover flap 14 foldably connected to major panel 12 along fold line 16. The cover flap 14 may have a protrusion 15 that may fit into a cutout 25 in pocket panel 20, to secure the cover flap in a closed position.

Side edge 32 may be provided with ring holes 18 to accommodate a 3-ring or similar binder. Tab 50 and opening 48 may be positioned to avoid interfering with ring holes 18. As an alternative to, or in addition to, ring holes 18, wire-binding holes 19 may be provided along side edge 32 so that the portfolio 11 may be bound into a wire binding such as a spiral or twin-wire binding. Ring holes 18 and/or wire-binding holes 19 may be similarly provided on the edge of divider 40', to accommodate the 3-ring binder or wire binding. Holes 18, 19 on all parts may be made before assembly, or after assembly, of the portfolio.

A wire binding if provided into wire-binding holes 19 may fasten divider 40' into the portfolio. However, tab 50 may still be useful to hold divider 40' in place if only a ring binding is used (e.g. in ring holes 18). Tab 50 may also be useful to fasten divider 40' into the portfolio if a wire binding is not applied to wire-binding holes 19 until later in the assembly process.

Although wire-binding holes 19 are depicted only with the portfolios in FIGS. 20-22, it should be understood that such holes might also be provided with the portfolios in the other Figures, for example in the vicinity of fold line 16.

The pocket/divider designs of the above embodiments can be used in nearly any pocket used alone, or used in pockets in conjunction with, or integrated into, other school and office items, such as binders, notebooks, portfolios, planners, date books, insert pockets and the like. The pocket/divider design provides an assembly that can be quickly and easily manufactured, yet provides a secure attachment mechanism due to the folded and attached nature of the tab.

Having described the invention in detail and by reference to the various embodiments, it should be understood that modifications and variations thereof are possible without departing from the scope of the claims of the present application.

One embodiment of the present invention provides a pocket assembly including first and second generally flat, parallel panels. The first panel is coupled to the second panel at least partially along at least one edge, and is not coupled to the second panel at least partially along another edge, to define a pocket therebetween. The pocket includes an opening formed therethrough. A divider including a tab is received in the pocket such that the tab extends through the opening and is attached to the pocket to thereby attach the divider to the pocket.

What is claimed is:

1. A pocket assembly comprising a major panel and a pocket panel coupled together to define a pocket therebetween and a divider placed in the pocket to partition the pocket into two or more compartments, the divider comprising a securing element secured to at least one of the major and pocket panels wherein the securing element comprises a folded tab extending from the divider and attached to the at least one of the major and pocket panels, and wherein the pocket is defined by respective inside surfaces of the major and pocket panels, the pocket is provided at a side thereof with an opening, and the tab extends through the opening and is attached to an outside surface of the at least one of the major and pocket panels.

2. The pocket assembly of claim 1, wherein the tab is folded flat against the outside surface of the at least one of the major and pocket panels to be attached thereto.

3. The pocket assembly of claim 1, wherein the opening is a slit formed along a side edge of the at least one of the major and pocket panels.

4. The pocket assembly of claim 3, wherein the major and pocket panels are pivotally secured together about the side edge.

5. The pocket assembly of claim 1, wherein the divider comprises at least one divider panel, and the tab is coupled to the at least one divider panel along a side edge of the at least one divider panel.

6. The pocket assembly of claim 5, wherein the divider comprises two or more divider panels, first and second ones of the two or more divider panels being foldably connected together along a common side edge thereof, and the tab is formed from the first divider panel and joined to the second divider panel along the side edge.

7. The pocket assembly of claim 6, wherein the first and second divider panels are folded about the common side edge into a face-to-face relationship such that the tab protrudes sideways from the second divider panel.

8. The pocket assembly of claim 5, wherein the divider comprises two or more separate divider panels each having the tab so that the each divider is individually coupled to the at least one of major and pocket panels by the tab of the each divider panel.

9. The pocket assembly of claim 1, wherein the major panel includes a set of openings formed therethrough, the openings being positioned and aligned to allow the pocket assembly to be coupled to a binding mechanism.

10. The pocket assembly of claim 1, wherein the pocket panel is generally rectangular in shape and securely coupled to the major panel along at least two secured outer edges, leaving at least one free outer edge unattached to the major panel, and the assembly further comprising a flap coupling one of the at least two secured outer edges of the pocket panel to the major panel to allow the pocket to expand.

11. A portfolio comprising a first major panel and a first pocket panel coupled together to define a first pocket between respective inside surfaces of the major and pocket panels and a first divider received in the pocket, the pocket panel having a side edge along which the pocket panel is coupled to the major panel to define a side of the pocket, the pocket being provided at the side thereof with an opening, the divider comprising a tab extending outwardly of the pocket through the opening and then folded and attached to an outside surface of one of the major and pocket panels.

12. The portfolio of claim 11, wherein the pocket panel is foldably coupled to the major panel along the outer side edge, the opening is formed along the outer side edge, and the tab is folded about the outer side edge onto the outside surface of the one of the major and pocket panels to be attached to the outside surface.

13. The portfolio of claim 11, further comprising a second major panel foldably coupled to the first major panel.

14. The portfolio of claim 13, further comprising a spine positioned between the first and second major panels.

15. The portfolio of claim 14, further comprising a binding mechanism mounted to one of the spine and either one of the first and second major panels.

16. The portfolio of claim 13, wherein a second pocket panel is coupled to the second major panel to define a second pocket between the second major panel and the second pocket panel.

17. The portfolio of claim 16, further comprising a second divider received in the second pocket, the second pocket panel being provided at a side thereof with an opening, the second divider comprising a tab extending outwardly of the second pocket through the opening of the second pocket and is attached to an outside surface of one of the second major and second pocket panels.

18. The portfolio of claim 13, wherein the first major panel and the second major panel are coupled about a fold line, and wherein the side of the pocket is generally parallel with the fold line.

19. The portfolio of claim 11, wherein the side of the pocket is generally perpendicular to a bottom of the pocket.

20. The pocket assembly of claim 1, wherein the side of the major and pocket panels is generally perpendicular to a bottom thereof.

* * * * *